United States Patent [19]

Arrieta

[11] 4,423,709

[45] Jan. 3, 1984

[54] METHOD AND APPARATUS FOR ECONOMIZING FUEL CONSUMPTION IN OPERATING A MULTICYLINDER INTERNAL COMBUSTION ENGINE

[76] Inventor: Francisco A. Arrieta, Rio Piedras, P.R.

[21] Appl. No.: 126,184

[22] Filed: Mar. 3, 1980

Related U.S. Application Data

[63] Continuation of Ser. No. 856,629, Dec. 2, 1977, abandoned, which is a continuation-in-part of Ser. No. 584,179, Jun. 5, 1975, abandoned.

[51] Int. Cl.[3] ..... F02B 77/00

[52] U.S. Cl. ..... 123/198 F; 123/90.11

[58] Field of Search ..... 123/198 F

[56] References Cited

U.S. PATENT DOCUMENTS

| | | | |
|---|---|---|---|
| 1,121,114 | 12/1914 | Moore | 123/198 F |
| 1,201,055 | 10/1916 | Jones | 123/198 F |
| 1,435,124 | 11/1922 | Mersch | 123/198 F |
| 1,570,914 | 1/1926 | Muller | 123/198 F |
| 1,898,602 | 2/1933 | Stamsvik | 123/198 F |
| 2,085,818 | 7/1937 | Messinger | 123/198 F |
| 2,114,655 | 4/1938 | Leibing | 123/198 F |
| 2,123,515 | 7/1938 | Messinger | 123/198 F |
| 2,443,999 | 6/1948 | Wright | 123/198 F |
| 2,528,983 | 11/1950 | Weiss | 123/198 F |
| 3,941,113 | 3/1976 | Baguelin | 123/198 F |
| 4,096,845 | 6/1978 | Holmes | 123/198 F |
| 4,151,824 | 5/1979 | Gilbert | 123/198 F |

*Primary Examiner*—Ronald B. Cox

*Attorney, Agent, or Firm*—Newton, Hopkins & Ormsby

[57] ABSTRACT

A method of economizing fuel consumption in operating an internal combustion engine having a group of combustion chambers of preselected numbers is disclosed. The method comprises the steps of consecutively introducing combustible fuel for ignition into each combustion chamber of the group to provide relatively high power availability for relatively high power demand, and of consecutively introducing combustible fuel for ignition into only selected combustion chamber members of the group numbering less than said preselected number to provide relatively low power availability for period of relatively low power demand.

An internal combustion engine is also disclosed comprising first and second sets of cylinders having pistons coupled with a common power train. First and second fuel intake mainfolds respectively communicate with the first and second sets of cylinders. First and second sets of intake valves are respectively mounted to the first and second set of cylinders for movement between valve opened and valve closed positions. First and second sets of rocker arms are mounted to move the first and second sets of intake valves respectively between the valve opened and valve closed positions. Cam means are provided for periodically urging the rocker arms to position member valves of the first and second sets of intake valves in the valve open positions. A set of rocker arm stops is mounted for movement into engagement with the first set of rocker arms to maintain them in a valve opened position for selected periods of time.

30 Claims, 12 Drawing Figures

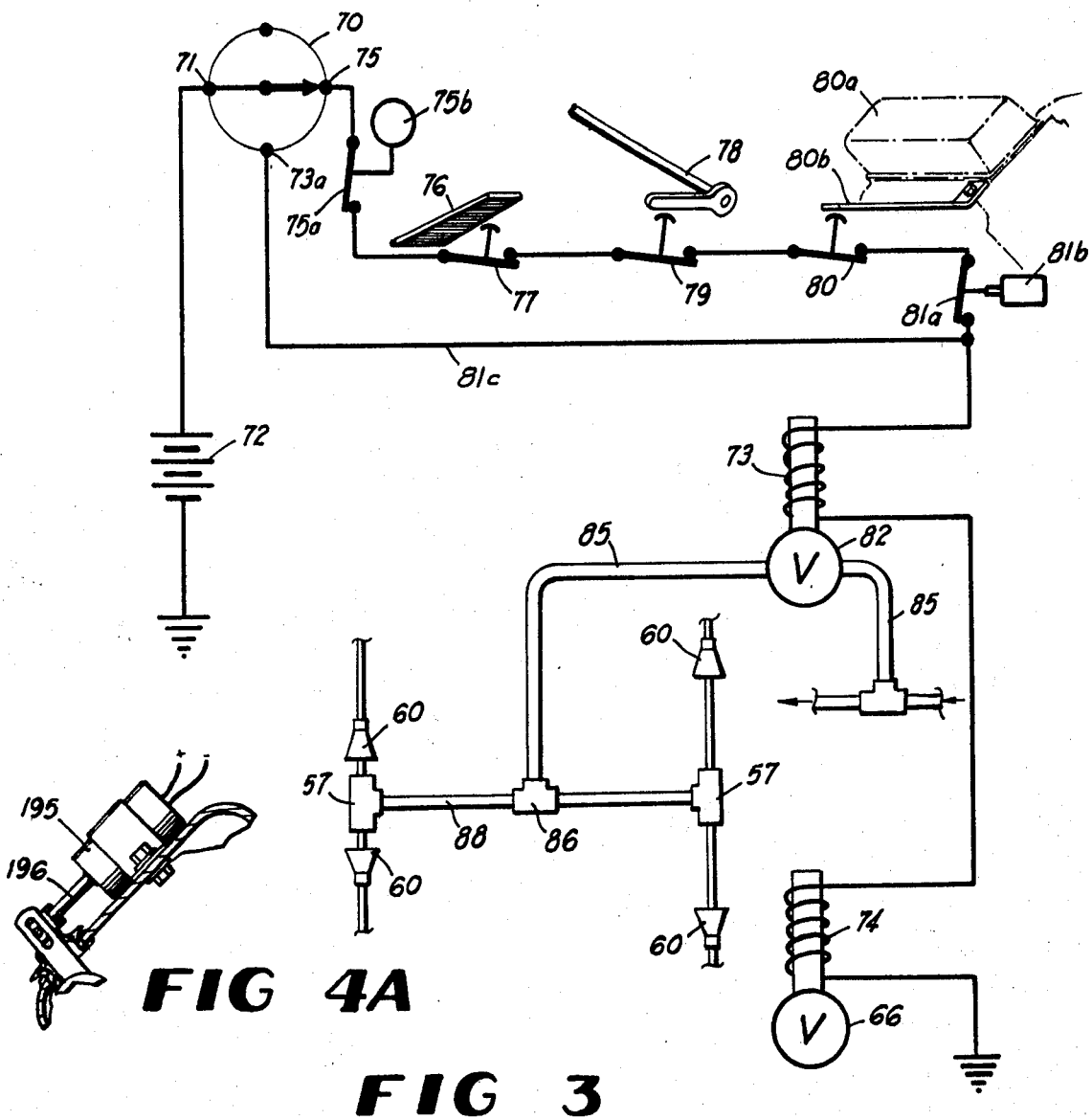
FIG 4A
FIG 3
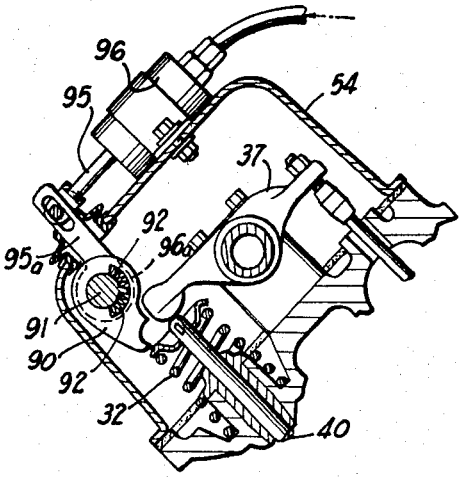
FIG 4
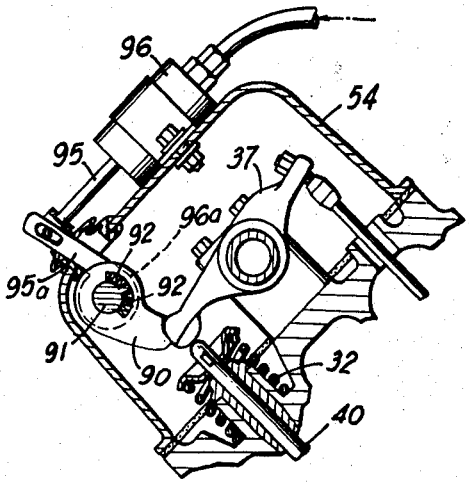
FIG 5

METHOD AND APPARATUS FOR ECONOMIZING FUEL CONSUMPTION IN OPERATING A MULTICYLINDER INTERNAL COMBUSTION ENGINE

CROSS REFERENCE TO RELATED APPLICATION

This is continuation of Application, Ser. No. 856,629 filed Dec., 2, 1977 now abandoned which was a Continuation-in-Part of my application Ser. No. 584,179, filed June 5, 1975 now abandoned.

BACKGROUND OF THE INVENTION

This invention relates generally to internal combustion engines, and particularly to multicylinder type internal combustion engines used in powering automobiles.

Varying power demands placed on automobile engines presents a technical dilemma. Where the engine is sufficiently powerful to handle high power demand conditions, it inherently has an excess of power availability during periods of relatively low power demand. Conversely, where the engine is constructed to meet only low power demand conditions efficiently, it fails to handle high power demands satisfactorily.

Previous attempts have been made to overcome the just described dilemma by periodically changing the number of operating cylinders as engine load conditions vary. U.S. Pat. Nos. 2,250,814, 2,394,738 and 2,652,038, for example, accomplish this by closing all valves to selected cylinders during low power demand conditions to render them temporarily inoperative. U.S. Pat. No. 2,673,617, for another example, accomplishes this through the use of multiple throttle valves. Though these approaches were feasible as modifications to automobile engines of the 1930's and 1940's, they are impractical and inefficient to incorporate into the automobile engines of today.

U.S. Pat. Nos. 2,085,818 and 2,114,655 disclose systems in which air is selectively admitted through intake manifolds to certain cylinders of an engine, so as to interrupt the draw of fuel and air from the carburator, such action being controlled by the voltage of the generator and the position of the throttle in U.S. Pat. No. 2,085,818 and by the vacuum in the manifold in U.S. Pat. No. 2,114,655. U.S. Pat. No. 1,121,114 discloses an engine in which the drive shaft to a portion of the engine is coupled and uncoupled, the intake valves of the uncoupled cylinders being opened during the period in which an uncoupled condition exists. The Applicant is also aware of the following additional U.S. Pat. Nos. 1,910,350; 3,578,116; 2,623,617 and 3,757,651.

Accordingly, it is a general object of the present invention to provide improved methods and apparatuses for economizing fuel consumption in operating internal combustion engines.

More specifically, it is an object of the present invention to provide an improved method of reducing the number of operating cylinders in a multicylinder internal combustion engine under low power demand conditions.

Another object of the invention is to provide an internal combustion engine having a plurality of combustion chambers with improved means for altering the number of combustion chambers in operation at any one time.

Another object of the invention is to provide means for converting existing internal combustion engines of automobiles to that of the type above described without need for modification of those portions of the engine housed within the engine block.

Yet another object of the invention is to provide an economical manner for altering existing multicylinder internal combustion engines to incorporate means for placing selected member combustion chambers in an inoperative condition while retaining operativeness of the unselected member combustion chambers.

SUMMARY OF THE INVENTION

In one form of the invention, a method is provided for economizing fuel consumption in operating an internal combustion engine having a group of combustion chambers of preselected number. The method comprises the steps of consecutively introducing combustible fuel for ignition into each combustion chamber of the group to provide relatively high power availability for period of relatively high power demand, and of consecutively introducing combustion chambers of the group while venting the unselected members of the group to ambient atmosphere to provide relatively low power availability for period of relatively low power demand.

In another form of the invention an internal combustion engine is provided comprising a group of combustion chambers and means for continuously venting selected member chambers of the group during periods of relatively low power demand to render them temporarily inoperative and thereby economize fuel.

In yet another form of the invention an internal combustion engine is provided comprising a plurality of cylinders, a plurality of valves operatively associated with said cylinders, means for continuously cycling each of the valves between valve opened and closed positions, and means for terminating the cycling by holding open selected valve members of the plurality of valves while the unselected valve members continue the cycle.

BRIEF DESCRIPTION OF THE DRAWING

FIG. 3 is a schematic view of a combined electrical and hydraulic control means associated with the internal combustion engine shown in FIGS. 1 and 2.

FIGS. 4 and 5 illustrate, partially in cross-section, modified portions of the internal combustion engine shown in FIG. 1 embodying principles of the invention in another form undergoing a sequence of operations.

FIG. 4*a* is a view similar to FIG. 4 and showing another modified form of the invention in which an electrical solenoid is used.

DETAILED DESCRIPTION OF THE DRAWING

Figure 1:
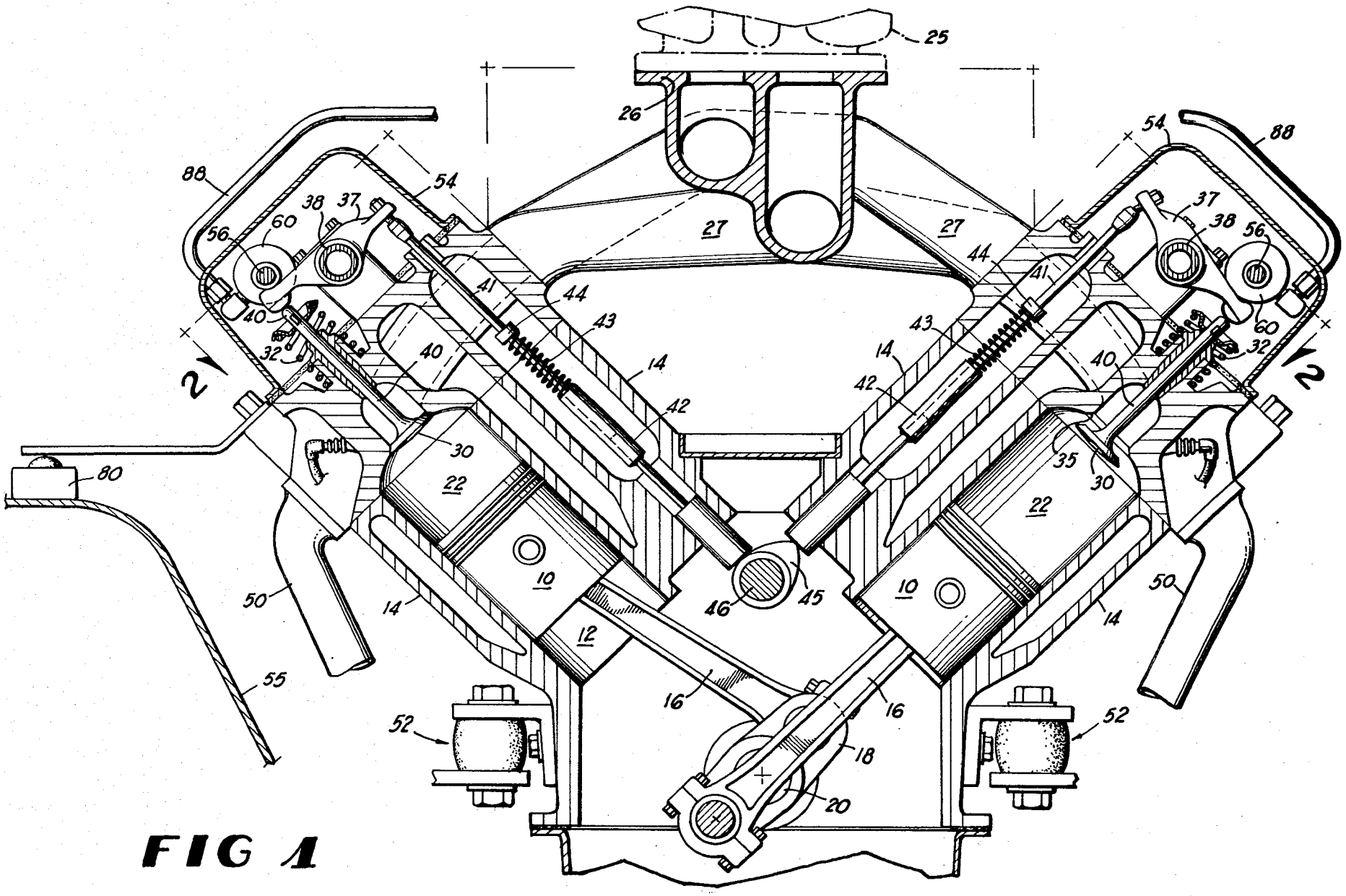
FIG. 1 is a transverse sectional view of an internal combustion engine embodying principles of the invention in a preferred form that is capable of practicing methods of the invention.

Referring now in more detail to the drawing, there is illustrated in FIG. 1 a conventional V-8 internal combustion engine for an automobile having the head thereof modified to incorporate principles of the invention. That portion of the engine illustrated here is seen to include two pistons 10 mounted for reciprocal, linear motion within cylinders 12 formed within engine block 14. A piston rod 16 extends from each piston 10 out the lower end of the cylinder to a crank 18 rigidly mounted to a crank shaft 20. The spaces within the cylinders above the pistons provide combustion chambers 22.

Figure 2:
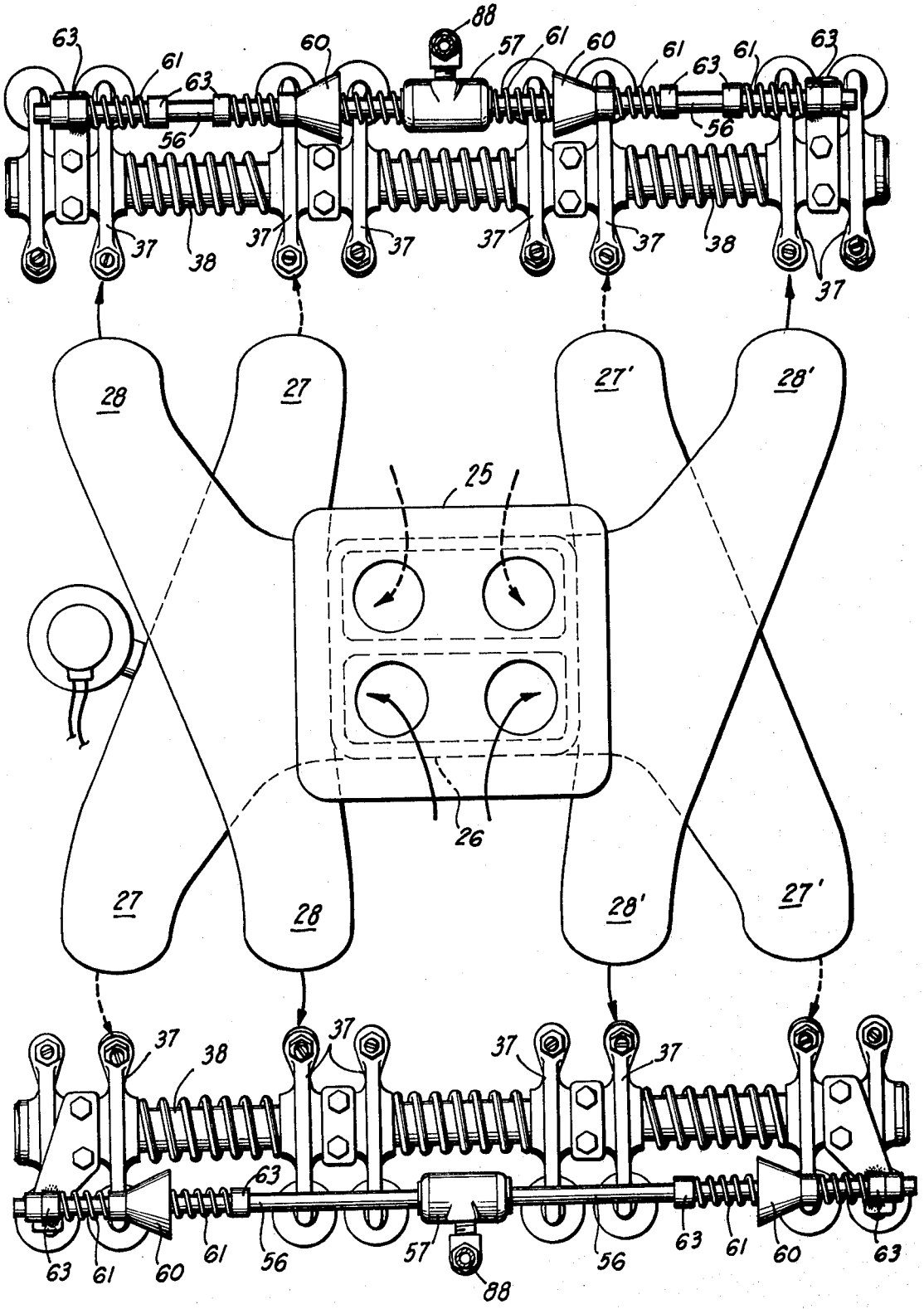
FIG. 2 is a plane view, partially schematic, of a portion of the internal combustion engine shown in FIG. 1.
Figure 6:
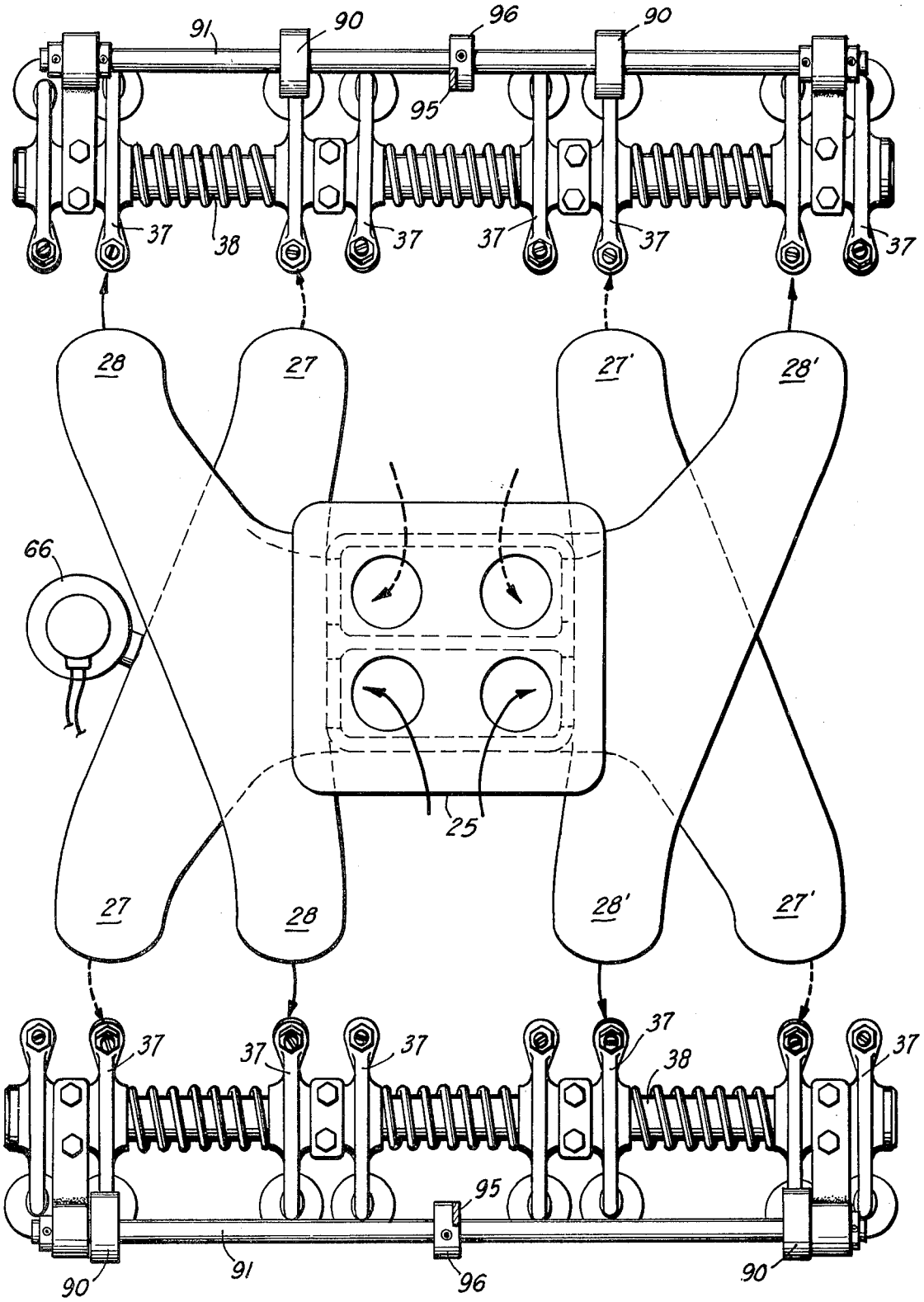
FIG. 6 is a plan-view, partially in schematic form, of a portion of an internal combustion engine incorporating the modification shown in FIGS. 4 and 5.

With reference next to both FIGS. 1 and 2 the engine is further seen to comprise a four barrel carburetor 25 mounted atop a carburetor mounting plate 26 which defines four barrels that respectively communicate with fuel intake manifolds 27, 27', 28 and 28'. Each of the four fuel intake manifolds communicates in turn with two cylinders within block 14. Momentary communication between the cylinder combustion chambers and the intake manifolds is controlled by means of fuel intake valves 30. Each fuel intake valve is continuously biased by means of a compression spring 32 into a closed position upon a conical seat 35. A conventional rocker arm 37 is provided for moving each of the fuel intake valves in conventional fashion. The rocker arms are mounted for rotation upon rocker arm shafts 38. One end of each rocker arm abuts an end of a valve stem 40 which extends from valve 30 through compression spring 32. The other end of each rocker arm is connected with a split rod type tappet or valve lifter movably housed within block 14. Each lifter comprises an upper rod 41 having its upper end pivotably secured to the rocker arm and its lower end telescopically received within the hollow upper end of a lower rod 42. A compression spring 43 is positioned about rod 41 with one end thereof in abutment with rod 43 and the other end in abutment with a stop 44 secured to rod 41. An enlarged lower end of each lifter abuts a cam 45 rigidly mounted to a rotatable cam shaft 46. With this configuration rotation of the cam shaft is seen to cause valve lifters 42 to reciprocate, causing the fuel intake valves to open and close consecutively in conventional Otto cycle fashion. Other conventional structural elements of the engine are seen to be an exhaust manifold 50, chassis motor mounts 52, head cover 54 and chassis 55.

With continued reference to FIGS. 1 and 2, means are seen to be provided for terminating the cycling of the fuel intake valves of four cylinders during period of relatively low power demand. This mechanism includes two pairs of push rods 56 that extend out the opposite ends of a pair of double acting cylinders 57. Each rod is seen to carry a conical rocker arm stop 60 which is loosely disposed about the rod between a pair of compression springs 61. The end of each compression spring distal the conical rocker arm stop is held stationary to the rod by means either of the double acting cylinders 57 themselves or a collar 63 rigidly secured to the rod. With this configuration it will be seen that actuation of the double acting cylinders serves to position the rocker arm stops 60 in abutment atop the rocker arms 37 thereby holding them in positions depressing valves 30 thereby holding them open.

While the fuel intake valves are depressed, rotation of cam 45 becomes ineffectual in imparting motion to the valve lifter upper rods 41. Instead, the lower rods merely ride up and down upon cam 45 alternately compression and decompressing springs 43. This insures that the tappet maintains its position within block 14 continuously atop the rotating cam 45. Simultaneous with this action butterfly solenoid valves 66 are actuated as hereinafter described, venting intake manifolds 27 and 27' which communicate with the combustion chambers through opened valves 30. In this manner the combustion chambers 22 are themselves vented to ambient atmosphere which inhibits their drawing combustible fluids from carburetor 25 as pistons 10 reciprocate in cylinders 12. Thus, four of the eight cylinders cease to be operative in imparting driving force to the power train. At the same time, drag which would be created by the evacuation of the combustion chamber does not arise which leaves the inoperative cylinder free to reciprocate. It should be specifically noted that no modification has been made to the engine block or engine components housed therein. Instead, they have been simply and economically made to the head and components operating therein. If desired, vent means could be built directly into the cylinder combustion chambers independent of the valves housed within the engine head.

With reference next to FIG. 3, a control system is shown for operating double acting cylinders 57. The control system is seen to include a switch 70 having a terminal 71 connected to ground through a battery 72 and two other alternately selectable terminals 73*a* and 75 coupled with serially connected coils 73 and 74 to ground.

Terminal 75 leads to the normally closed series connected interlock switches 75*a*, 77, 79 80 and 81*a*. Switch 75*a* is connected to a thermocouple 75*b* which opens and closes the switch 75*a*. Switch 75*a* remains open until the engine reaches normal operating temperature and is then closed. Switch 77 is normally closed but is opened by the throttle foot pedal 76 when depressed beyond a preselected limit of the carburetor throttle valve opening where all cylinders are needed for the power required. For example, the switch 77 is connected to the linkage 76*a* of the carburetor bufferfly valve so as to open when the butterfly valve is opened more than 45°.

Switch 79 is opened when the gear lever 78 is shifted away from third or neutral gear. Switch 81*a* is operated by the transmission mechanism 81*b* and is opened when transmission is in, the intermediate gears.

When switch 70 connects terminals 71 and 73*a* these switches 77, 79, 80 and 81*a* are bypassed or shunted via wire 81*c* so as to energize coils 73 and 74, regardless of the positions of switches 77, 79, 80 and 81*a*.

When however, switch 70 is positioned to connect terminal 75 with terminal 71 and battery 72, a circuit is established energizing coils 73 and 74 only so long as the engine is within its normal operating temperatures or automobile accelerator pedal 76 is not in a position beyond about 45° to open switch 77, or a low gear shift lever 78 is not positioned to actuate a switch 79, or an engine torque switch 80 is not actuated by high torque or the switch 81*a* is not actuated by the hydraulic transmission being in less than its normal drive.

With coils 73 and 74 energized, valve 82 serves to actuate the double acting cylinders 57 in urging the rocker arm stops into position for low power operation. This is accomplished by means of an hydraulic line 85 which communicates by means of T couplings 86 to branch lines 88 and cylinders 57. In this mode of operation should more power be demanded as by maximum depression of accelerator 76, transmission to low gear, or in high engine torquing switch 77, 79 or 80, or a combination thereof, open thereby de-energizing valves 82. This causes the double acting cylinders to disengage rocker arm stop 60. Simultaneous with the de-activation of valves 82, butterfly solenoid valves 66 are de-energized which terminates the venting of intake manifold 27 and 27' to ambient atmosphere. In urging stops 60 against the rocker arms, springs 51 cushion impact.

With reference next to FIGS. 4, 4*a*, 5 and 6, means for maintaining valves 30 in a valve open position are shown in alternative forms. Here, rocker arms 37 may be held depressed by cams or levers 90 pivotally mounted to rods 91. These cams or levers 90 have a limited degree of rotary movement relative the rods 91 under the bias provided by springs 92. Relative movement by the cams 90 with respect to the rods against a spring 92 provides shock absorbing means as the cams engage the rocker arms 37. Rods 91 themselves are rotated by means of a crank arm 95*a* mounted to a fixed collar 96*a*. Upon actuation of a hydraulic cylinder 96, cams 90 engage and hold the rocker arms 37 in the position shown in FIG. 5, thereby holding valve stems 40 depressed against the action of springs 32 to hold the fuel intake valves open. Deactivation of cylinders 96 returns the cams 90 to the position shown in FIG. 4, thereby releasing the rocker arms 37, enabling them to assume their normal Otto cycling motion. Cylinders 96 are actuated in a similar manner to that previously described in FIG. 3 in conjunction with double acting cylinders 57. It will be understood, of course, that solenoids, such as solenoid 196, seen in FIG. 4*a*, can be substituted for the cylinder 96, if desired, without departing from the scope of this invention. Solenoid 196 is disposed in place of all the hydraulic systems including solenoids 73 and 74. The energizing of solenoid 196 will extend rod 195. Rod 195 acts in the identical manner as rod 95 in rotating cam 90 to hold open the intake valve, once the rocker arm 37 has opened the valve. The retracting of rod 195 when solenoid 196 is de-energized causes release of rocker arm 37.

Figure 7:
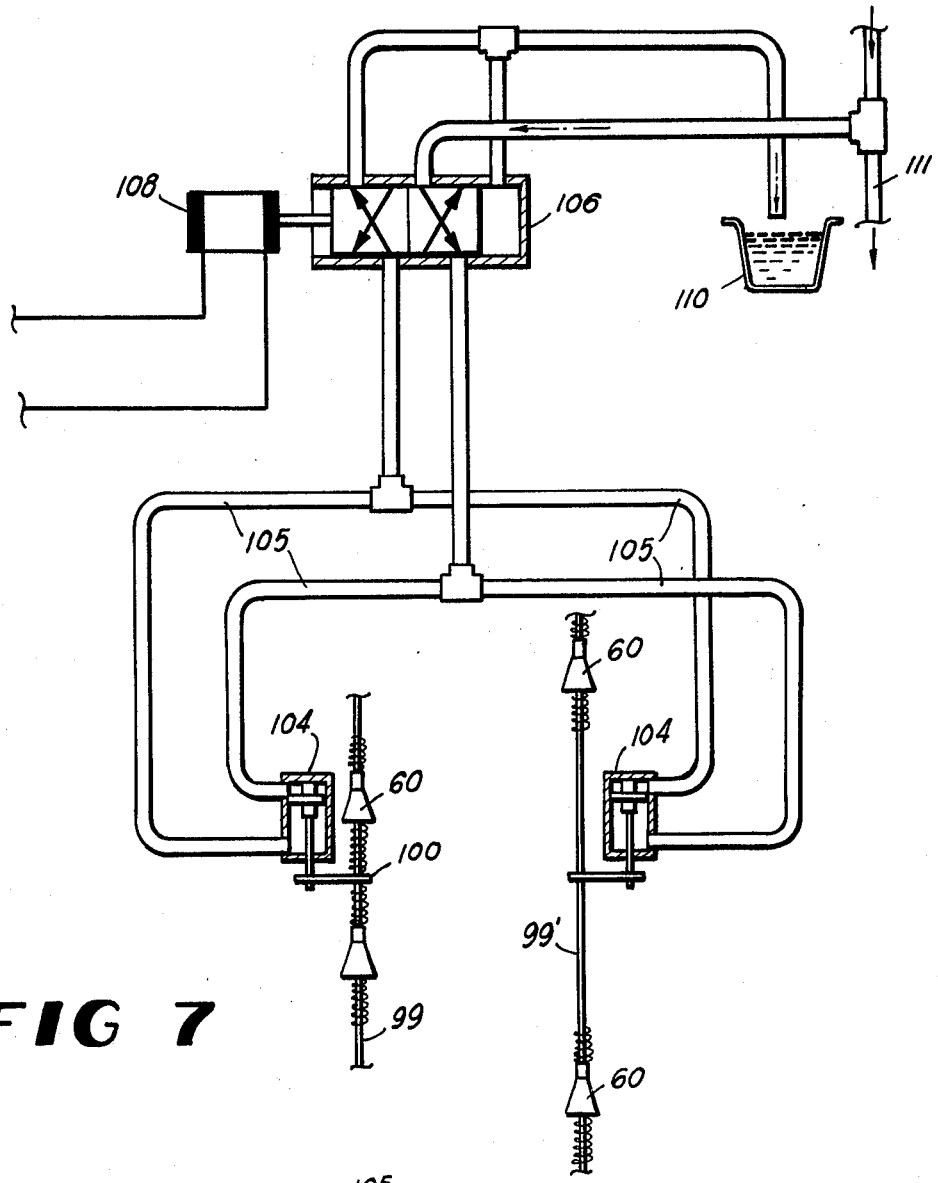
FIG. 7 is a schematic view of a combined electrical and hydraulic control means for operating the internal combustion engine components shown in FIGS. 8 and 9.
Figure 8:
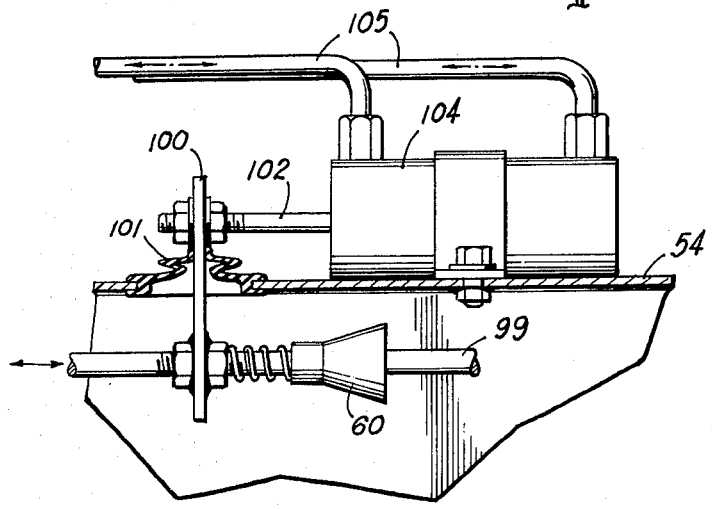
FIG. 8 is a fragmentary view of yet another modification to the internal combustion engine shown in FIG. 1.
Figure 9:
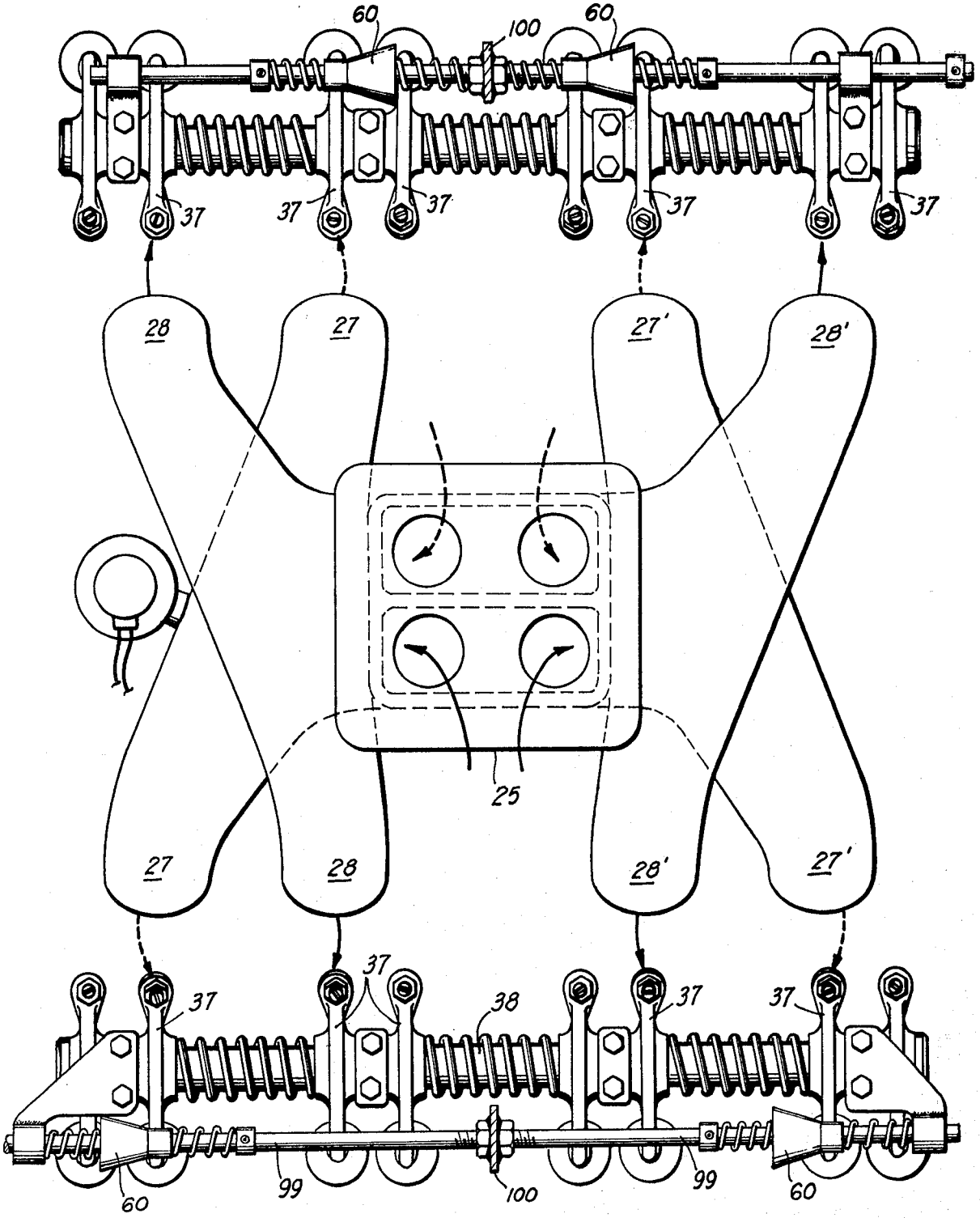
FIG. 9 is a plan-view, partially schematic, of an internal combustion engine incorporating the control means shown in FIG. 7 and the modifications shown in FIG. 8.

Referring next to FIGS. 7, 8 and 9, yet another embodiment is illustrated similar to that shown in FIGS. 1 and 2. Here, however, pairs of rocker arm stops 60 are mounted to single, unitary rods 99 and 99' rather than to pairs of individual rods. In this manner actuation of each pair occurs by movement of one rod in one direction. Specifically, the rods are driven by rigid coupling members 100 mounted to the rods with one end passing through a flexible gasket 101 covering an aperture in head cover 54 to a piston rod 102. The piston rods are in turn mounted to pistons housed within cylinders 104 to which pairs of hydraulic lines 105 communicate. Lines 105 are connected through a shuttle valve 106, actuatable by means of a solenoid 108.

As shown previously in FIG. 4A, cylinder 104 of FIG. 8 can be replaced by an electrically operated solenoid 106 replacing all the hydraulic circuit.

Figure 10:
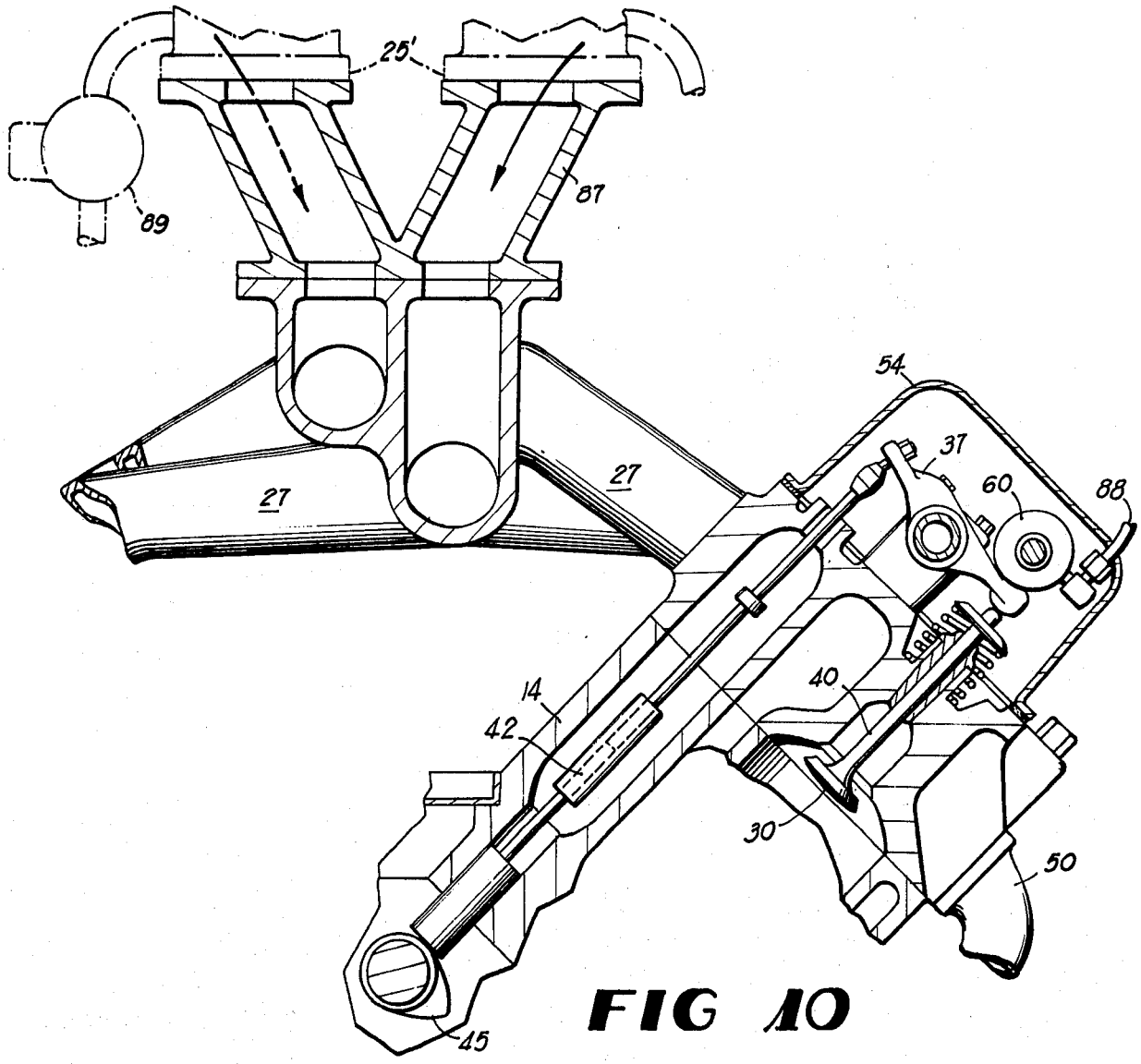
FIG. 10 illustrates, partially in cross-section, another modification of the internal combustion engine shown in FIG. 1.
Figure 11:
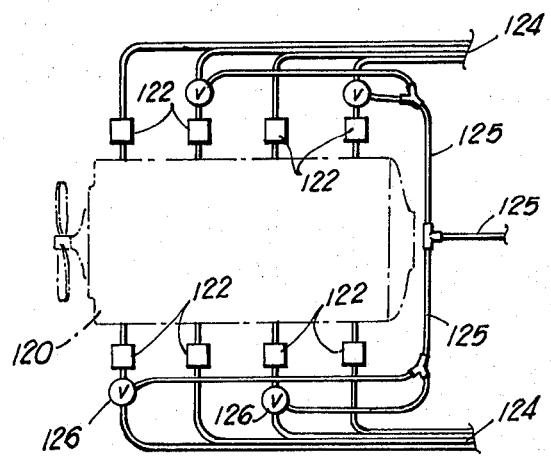
FIG. 11 is a schematic diagram of a fuel control system for diesel and gasoline fuel injection engines embodying the invention.

If desired, means may be provided for actually terminating the flow of fuel to the carburetor in communication with inoperative combustion chambers. Such a modification is shown in FIG. 10 wherein two, two-barrel carburetors 25' are shown independently mounted atop an adapter 87 which itself is mounted atop the carburetor mounting place. A solenoid actuatable valve 89 is mounted in the fuel line that communicates with that carburetor operatively associated with the cylinders adapted to be temporarily rendered inoperative. The solenoid is preferably connected in parallel circuit with butterfly solenoid valves 66 for simultaneous operation therewith. Where fuel injectors are used in lieu of carburetors, such as with diesel and gasoline injected internal combustion engines, shut off valves may also be used. FIG. 11 exemplifies one such arrangement for a V-8 engine 120 having eight intake fuel lines 124 leading to eight fuel injectors 122. Four solenoid actuated valves 126 are incorporated into the lines 124 leading to the injectors 122. When valves 126 are actuated they interrupt the flow of fuel to their respective injectors 122 and directs all such fuel, via lines 125, back to the fuel tank.

While I have illustrated, in the present invention, employing cams 60 and 90 to hold open the intake valves 40, a similar result could be obtained by using eccentric bushings on the rocker arms to lift the rocker arms to hold the valves closed rather than opened; however, the engine in such a situation runs in a rough manner and, therefore, such a procedure is not recommended.

The fuel economy, using my invention is quite noticeable. For example, in an automobile which normally travelled about 9½ miles per gallon, my invention increased this about 12½ miles per gallon.

It should be understood that the just described embodiments merely illustrate principles of the invention in selected, preferred forms. Many modifications, additions and deletions may, of course, be made thereto without departing from the spirit and scope of the invention as set forth in the following claims.

I claim:

1. A method of economizing fuel consumption in operating an internal combustion engine having first and second groups of combustion chambers, respectively having reciprocating pistons therein, the first group communicating through intake valves with a first intake manifold and the second group communicating through intake valves with a second intake manifold separate from said first manifold, the steps of consecutively introducing combustible fuel through the manifolds into each combustion chamber of the groups for ignition in the chambers to provide relatively high power availability for periods of relatively high power demand, and of consecutively introducing combustible fuel for ignition into only the first manifold for combustion in the chamber of the first group while continuously holding open the intake valves of the second group and venting the second manifold to ambient air for thereby venting the combustion chambers of the second group to ambient atmosphere so that they do not build up appreciable compression in the chambers of the second group, while continuing the reciprocating of all of said pistons to provide relatively low power availability for periods of relatively low power demand.

2. An internal combustion engine comprising a group of combustion chambers with reciprocating pistons therein and means for continuously venting during reciprocating of all pistons selected member chambers of said group during periods relatively low power demand to render them temporarily inoperative and thereby economize fuel, a group of fuel intake valves operatively associated with said group of combustion chambers, and said continuous venting means includes means for continuously positioning selected member intake valves of said group of valves open to the ambient air, isolated from fuel and isolated from the intake valves of the other chambers during the periods of relatively low power demand.

3. An internal combustion engine comprising a common block including a cylinder head having first and second sets of cylinders and pistons reciprocated therein and coupled continuously with a common drive shaft of a common power train, first and second fuel intake manifolds connected to said block and respectively communicating with said first and second sets of cylinders; first and second sets of intake valves mounted in said block between the manifolds and said first and second sets of cylinders respectively for movement between valve opened and valve closed positions; said intake valves being biased to closed positions; first and second sets of rocker arms mounted on said block for moving said first and second sets of intake valves respectively, said rocker arms rocking in individual rocking paths between the valve closed and valve open positions; cam means for periodically urging said rocker arms to position member valves of said first and said second sets of intake valves in the valve opened positions; and a set of rocker arm stops moveably mounted adjacent to said rocker arms for respective movement into and out of the rocking paths of the first set of rocker arms, means for moving said stop means into positions engaging said first set of rocker arms and blocking appreciable movement of said first set of rocker arms when said first set of rocker arms respectively open their associated valves for blocking travel of such rocker arms with their valve open and for maintaining such valves in their valve opened positions for a selected period of time during which all pistons continue to be coupled with said common drive shaft of said power train and continue to reciprocate.

4. An internal combustion engine comprising a plurality of cylinders; a plurality of valves operatively associated with said cylinders; means for continuously cycling each of said valves between opened and closed positions; and terminating means for terminating the cycling by holding open selected valves of said plurality of valves while the unselected valves continue to cycle, said cycling means including a plurality of rocker arms operatively associated with said plurality of valves said terminating means including a plurality of rocker arm stops and means for moving said rocker arm stops into and out of engagement with selected rocker arm members of said plurality of rocker arms, each of said rocker arm stops being conical, and each of said conical rocker arm stops being mounted for axial movement.

5. An internal combustion engine comprising first and second sets of cylinders having pistons coupled with a common power train, first and second fuel intake manifolds respectively communicating with said first and second sets of cylinders; first and second sets of intake valves mounted to said first and second sets of cylinders respectively for movement between valve opened and valve closed positions; first and second sets of rocker arms mounted to move said first and said second sets of intake valves respectively between the valve opened and valve closed positions; cam means for periodically urging said rocker arms to position member valves of said first and said second sets of intake valves in the valve opened positions; and a set of rocker arm stops mounted for movement into engagement with said first set of rocker arms to maintain them in the valve opened position for selected periods of time, an exterior surface of each of said rocker arm stops being conical, each of said rocker arm stops being mounted for movement axially of said conical exterior surface.

6. In an internal combustion engine having a plurality of rocker arms pivotally mounted on the cylinder head of said engine, said rocker arms rocking for respectively periodically opening a plurality of engine cylinder valves, the improvement comprising a plurality of intake rocker arm control means moveably positioned on said head adjacent to certain selected intake rocker arms of said plurality of rocker arms and means for moving said intake rocker arm control means into engagement with and to arrest movement of said selected intake rocker arms when they open their associated intake valves to hold such valves in open positions and fuel arresting means for arresting the flow of the fuel to said selected cylinders as the pistons thereof continue to reciprocate.

7. A method of economizing fuel consumption in operating an Otto cycle type internal combustion engine having a plurality of cylinders, having a common integral crankshaft, a plurality of reciprocating pistons continuously connected to the common crank shaft and a plurality of intake valves operatively associated with each cylinder through which combustible fuel is introduced into the cylinders for ignition and exhaust valves through which combusted gases are exhausted from the cylinders, said method comprising the steps of continuously cycling the intake and exhaust valves of each cylinder between opened and closed positions in providing relatively high power availability for periods of relatively high power demand, and of continuously cycling the valves of one group of said cylinders between opened and closed positions while maintaining the intake valve of each cylinder of another group of said cylinders continuously open while reciprocating at a common speed of all of said pistons connected to the common drive shaft in providing relatively low power availability for periods of relatively low power demand, a fuel intake valve of each cylinder of said other group being maintained isolated from fuel and continuously open and communicating with the ambient air during the periods of relatively low power demand.

8. The engine defined in claim 6 including spring members positioned adjacent to each of said stop members for yieldably urging the stop members into their positions in the path of travel of their rocker arms, whereby when the arms are in position to open their respective valves, said spring means urge their respective stop members into such paths.

9. The engine defined in claim 6 wherein said engine has cams and lifters actuated by said cams, said lifters engaging said rocker arms for imparting rocking motion thereto, and resilient means connected to the lifters which actuate said member arms, said resilient means yieldably urging their associated lifters into engagement with the cams which actuate such lifters and also the rocker arms with which such push rods are associated during periods in which rocking action of the rocker arms is arrested.

10. The engine defined in claim 9 wherein each of said lifters includes an upper rod and a lower rod in alignment with each other and with their inner ends adjacent to each other, said yieldable means including a spring extending around one of the rods for urging the ends of the upper rod and lower rod apart, and means for holding said upper rod and said lower rod in alignment.

11. The engine defined in claim 6 wherein said rocker arm control means includes a plurality of rocker arm stop members, a rod slideably carrying said rocker arm stop members and means for yieldably urging said stop members into the paths of rocking of said selected member arms, whereby when said rocker arms are in positions opening said valves, said stop means are urged into blocking positions blocking movement of their respective rocker arms.

12. The engine defined in claim 11 wherein said means for yieldably urging said stop members into the paths of their associated member arms includes a hydraulic cylinder for moving said stop members and for returning said stop members to their positions adjacent to selected member arms.

13. The engine claimed in claim 12 including means remote from said cylinder for controlling the actuation of said cylinder.

14. The engine defined in claim 12 including spring members positioned adjacent to each of said stop members for yieldably urging the stop members into their positions in the path of travel of their member arms, whereby when the arms are in position to open their respective valves, said spring means urge their respective stop members into such paths.

15. An internal combustion engine in accordance with claim 5 comprising at least one shaft about which said stops are disposed, and a set of springs disposed about said at least one shaft in engagement with opposite ends of each of said steps.

16. An internal combustion engine in accordance with claim 15 comprising means for axially reciprocating said shaft to move said rocker arm stops into and out of engagement with said first set of rocker arms.

17. An internal combustion engine in accordance with claim 5 comprising at least one shaft to which said stops are mounted, and means for rotating said shaft to move said stops into and out of engagement with said first set of rocker arms.

18. The engine defined in claim 3 including means for connecting said first set of valves to the ambient air when the movement of first set of rockers arms is arrested.

19. The engine defined in claim 3 wherein said rocker arms stops each includes a hydraulic cylinder for each of said first set of rocker arms and a lever actuated by said cylinder for engaging its associated rocker arm when its has opened its valve.

20. An internal combustion engine in accordance with claim 5 comprising at least one shaft about which said stops are disposed, and a set of springs disposed about said at least one shaft in engagement with opposite ends of each of said stops.

21. An internal combustion engine in accordance with claim 20 comprising means for axially reciprocating said shaft to move said rocker arm stops into and out of engagement with said first set of rocker arms.

22. An internal combustion engine in accordance with claim 5 comprising at least one shaft to which said stops are mounted, and means for rotating said shaft to move said stops into and out of engagement with said first set of rocker arms.

23. The internal combustion engine defined in claim 6 including interlock means for rendering ineffective said control means and said fuel arresting means ineffective.

24. An internal combustion engine defined in claim 11 wherein said interlock means includes a thermostatic switch which permits operation of the control means only at normal operating temperatures of the engine.

25. The internal combustion engine defined in claim 23 wherein said interlock means includes a throttle switch actuated when the throttle pedal is depressed.

26. The internal combustion engine defined in claim 23 wherein said interlock means includes a switch actuated when the gear shift is in low.

27. The internal combustion engine defined in claim 23 wherein said interlock means includes a switch actuated by the torque of the engine.

28. The internal combustion engine defined in claim 23 wherein said interlock means includes a switch actuated by the condition of the hydraulic transmission of the engine.

29. A method of economizing fuel consumption in accordance with claim 1 wherein ambient air is cyclically introduced into and exhausted from the unselected members of the group of combustion chambers during each cycle of the piston of that chamber and during the periods of relatively low power demand.

30. A method of economizing fuel consumption in accordance with claim 7 wherein an intake manifold through which fuel is drawn to the fuel intake valves of said other group of cylinders is continuously vented to ambient air while said fuel intake valves of said other group of cylinders are maintained continuously open.

* * * * *